US005957172A

United States Patent [19]

DeGreef et al.

[11] Patent Number: 5,957,172

[45] Date of Patent: Sep. 28, 1999

[54] AUTOMATED MOBILE SANDBAG UNIT

[76] Inventors: Roger W. DeGreef, 46917 Fox Run, Macomb, Mich. 48044; Richard L. DeGreef, 30502 SandHurst, Roseville, Mich. 48066

[21] Appl. No.: 09/003,348

[22] Filed: Jan. 6, 1998

Related U.S. Application Data

[60] Provisional application No. 60/035,755, Jan. 6, 1997.

[51] Int. Cl.[6] ..... B65B 1/00

[52] U.S. Cl. ..... 141/166; 141/10; 141/114; 141/314; 53/570

[58] Field of Search ..... 141/10, 166, 284, 141/313–317, 231, 114; 53/570, 571, 572

[56] References Cited

U.S. PATENT DOCUMENTS

| | | | |
|---|---|---|---|
| 2,343,439 | 3/1944 | Allen et al. | 141/314 |
| 2,463,085 | 3/1949 | Byberg | 141/314 |
| 2,514,867 | 7/1950 | Howard et al. | 141/314 |
| 2,671,585 | 3/1954 | Kindseth | 141/314 |
| 3,215,173 | 11/1965 | Rutherford | 141/314 |
| 3,552,346 | 1/1971 | Garden | 141/313 |
| 3,602,402 | 8/1971 | Garden | 222/196 |
| 3,855,907 | 12/1974 | Johnson et al. | 53/570 |
| 4,044,921 | 8/1977 | Caverly | 222/74 |
| 4,184,522 | 1/1980 | Waite | 141/231 |
| 4,249,361 | 2/1981 | Tetenborg et al. | 53/570 |
| 4,253,292 | 3/1981 | Lipes | 53/572 |
| 4,291,517 | 9/1981 | Lipes | 53/572 |
| 4,344,468 | 8/1982 | Sandberg | 141/314 |
| 4,432,186 | 2/1984 | McGregor | 141/314 |
| 4,819,701 | 4/1989 | Thornton | 141/231 |
| 5,036,893 | 8/1991 | DeCrane | 141/114 |
| 5,121,775 | 6/1992 | McClain | 141/231 |
| 5,215,127 | 6/1993 | Bergeron | 141/10 |
| 5,222,535 | 6/1993 | Roders | 141/314 |
| 5,425,403 | 6/1995 | Herrmann | 141/314 |
| 5,452,567 | 9/1995 | Lieder | 53/570 |
| 5,535,792 | 7/1996 | McGregor | 141/316 |
| 5,806,576 | 9/1998 | Sutherlin | 141/314 |

*Primary Examiner*—J. Casimer Jacyna
*Attorney, Agent, or Firm*—Howard & Howard

[57] ABSTRACT

A sandbag filling machine generally comprises a plurality of sandbag carriers movably around a circuit by an indexing machine. The sandbag carriers are moved among a plurality of stations including a sand supply unit and a sandbag sealer. Fasteners on each sandbag carrier selectively open and close the sandbag.

14 Claims, 6 Drawing Sheets

AUTOMATED MOBILE SANDBAG UNIT

This application claims priority to U.S. provisional application Ser. No. 60/035,755 filed Jan. 6, 1997.

BACKGROUND OF THE INVENTION

Very heavy or extended precipitation can lead to flooding. Similarly, heavy tropical storms can cause flooding of low lying coastal areas. The damage caused by these floods is greatly reduced if residents are able to create sandbag dikes to confine the water to non-residential areas. In order to be effective, such dikes require a large number of sandbags and must be assembled quickly.

There are several problems, however, with creating these sandbag dikes. First, filling sandbags by hand, the usual method, is very time consuming and requires large numbers of people to create a typical sandbag dike. Second, the site of the sand and the site of the potential flood are often distanced from each other, thus a sandbag filling crew and a sandbag dike building crew are both needed. Typically, the sandbags will have to be transported from the filling site to the flood site.

SUMMARY OF THE INVENTION

The subject invention relates to a high speed, high capacity, and completely mobile sandbag filling machine which can be operated by only two persons.

The sandbag filling machine generally comprises a plurality of sandbag carriers moveable around a circuit among five stations. First, empty sandbags are mounted on the sandbag carrier assembly at a loading station. The sandbag carrier assembly then moves to the next station where an upper cylinder of the sandbag carrier is filled with sand from a sand supply unit. At a third station, the sand from the sand carrier is dropped into the sandbag. The sandbag is then sealed at the next station, such as by heat sealing or staples. The sandbag is then removed from the sandbag carrier at a discharge station and the empty sandbag carrier is refilled at the loading station. By separating these steps into different stations, the sandbags are filled quickly and efficiently.

Each sandbag carrier comprises and upper cylinder and a lower portion. The lower portion includes a pair of opposed plates each having a plurality of fasteners removably secured to the sandbag. Generally the plates maintain the sandbag in an open position until the sandbag is moved to the sealing station. At the sealing station, the plates are brought together, thereby generally closing the sandbag. Heat sealers seal the sandbag below the fasteners. Then, the plates are separated again at the discharge station, where the fasteners are forcibly removed from the sandbag, such as by tearing tear portions in the sandbag. In this manner, a large number of sandbags can be filled and sealed quickly by only one or two people.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
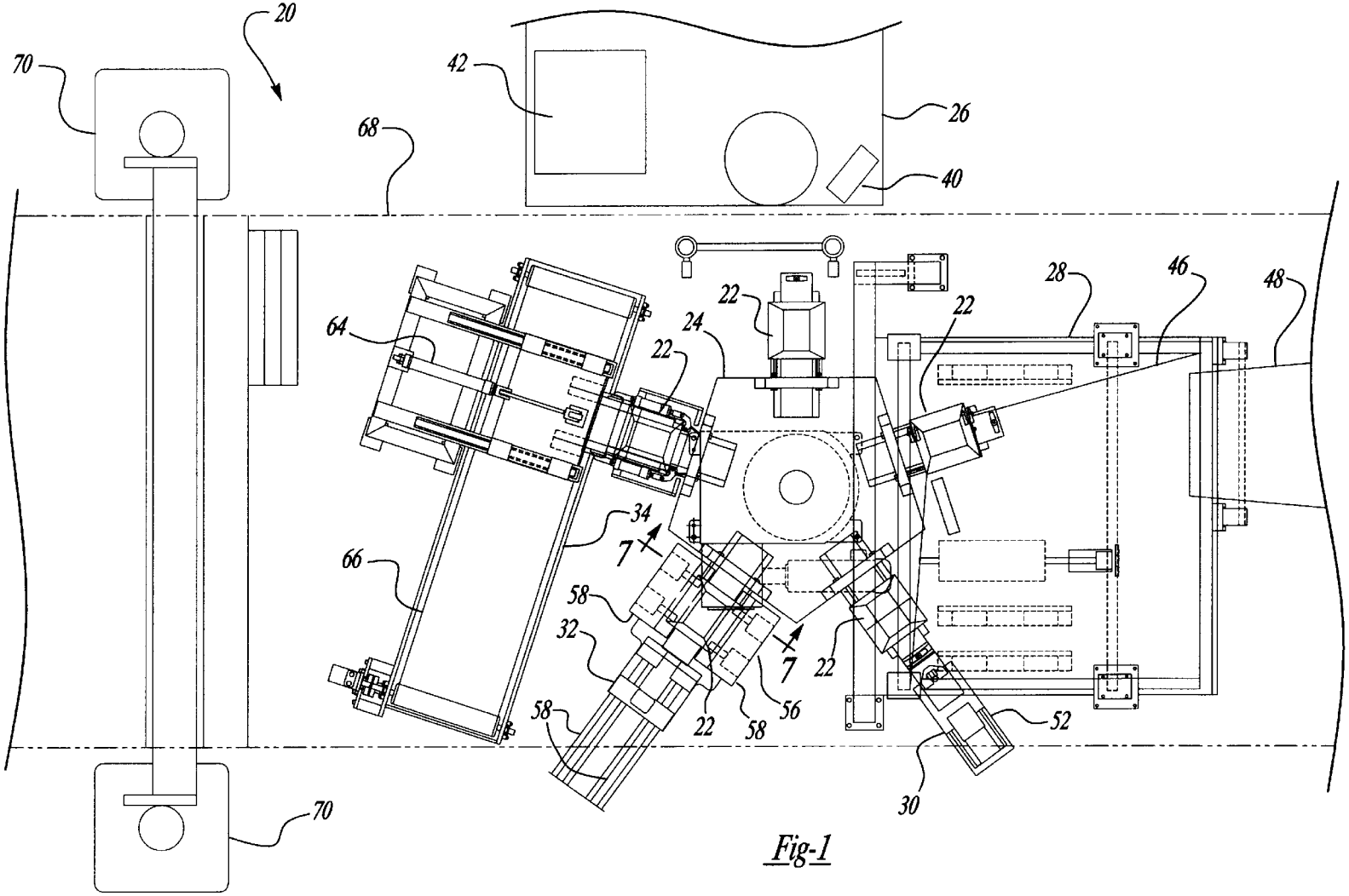
FIG. 1 is a plan view of the sandbag filling machine of the present invention.

A sandbag filling machine 20 according to the present invention is shown in a plan view in FIG. 1. The sandbag filling machine 20 generally comprises a plurality, preferably five, sandbag carrier assemblies 22 which are rotated clockwise by an indexing unit 24. The sandbag carrier assemblies 22 travel around a circuit which includes a loading station 26, a cylinder fill station 28, a bag fill station 30, a sealing station 32 and a discharge station 34.

The loading station 26 generally includes a control unit 40, which may include a microprocessor or other known control circuitry, for controlling the sandbag filling machine 20. A plurality of empty sandbags 42 are provided at the loading station 26.

The cylinder fill station 28 includes a lower fill chute 46 which leads into the adjacent sandbag carrier assembly 22. An upper fill chute 48 provides sand into the lower fill chute 46.

The bag fill station 30 includes a hydraulic actuator 52 for causing sand from the sandbag carrier assembly 22 to be dropped into a sandbag. The sealing station 32 includes a seal unit 56 slideably mounted on one or more rails 58 toward and away from the indexing unit 24. The seal unit 56 includes a pair of heat sealers 60 which selectively constrict and seal the sandbag on the adjacent sandbag carrier assembly 22. The operation of the seal unit 56 will be described in more detail below.

The discharge station 34 includes a hydraulic actuator 64 for moving a sandbag from an adjacent sandbag carrier assembly 22 onto an adjacent chute 66. Preferably, the sandbag filling machine 20 is mounted on a flat bed trailer 68 which includes a plurality of hydraulic stabilizing jacks 70.

Figure 2:
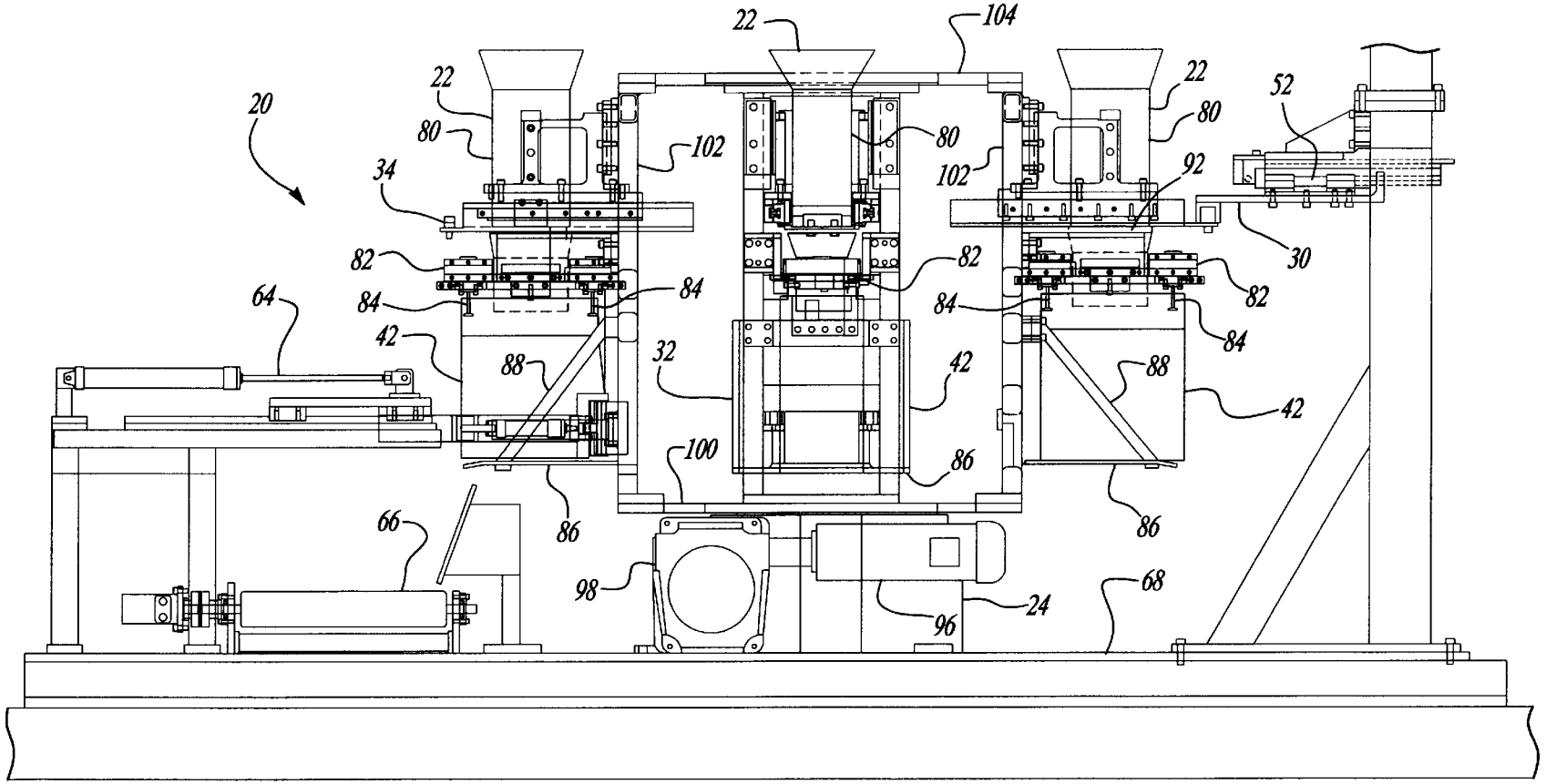
FIG. 2 is a slightly modified side view of the indexing unit and sandbag carrier assembly of FIG. 1.

In FIG. 2, three sandbag carrier assemblies 22 are shown mounted on the indexing unit 24 in a side view, slightly modified for clarity. The indexing unit 24 holds the sandbag carrier assemblies 22 on sides of a pentagon, but the sandbag carrier assemblies 22 in FIG. 2 are shown at right angles for clarity. As can be seen in FIG. 2, each of the sandbag carrier assemblies 22 comprises an upper cylinder 80 and a lower portion 82. A plurality of fasteners 84 for securing to a sandbag 42 extend downwardly from the lower portion 82. A shelf 86 for supporting the sandbag 42 is positioned below the sandbag carrier assembly 22 and supported by bracket 88. A trap door 92 between the upper cylinder 80 and lower portion 82 is selectively opened and closed by the hydraulic actuator 52 at the bag fill station 30. As can be seen in FIG. 2, the indexing unit 24 generally includes a motor 96 operating gearing 98 driving a lower plate 100. A plurality of posts 102 extend upwardly from the lower plate 100 and are reinforced by an upper plate 104. The sandbag carrier assemblies 22 are mounted to the posts 102. The indexing unit rotates the lower plate, posts 102, upper plate 104 and sandbag carrier assemblies 22 through the various stations, including the bag fill station 30, sealing station 32, and discharge station 34. The indexing unit 24 is preferably a commercially available unit, such as a Camco 180ORDM, five-position heavy duty, low profile indexing unit. Other indexing units 24 may also be utilized.

Figure 3:
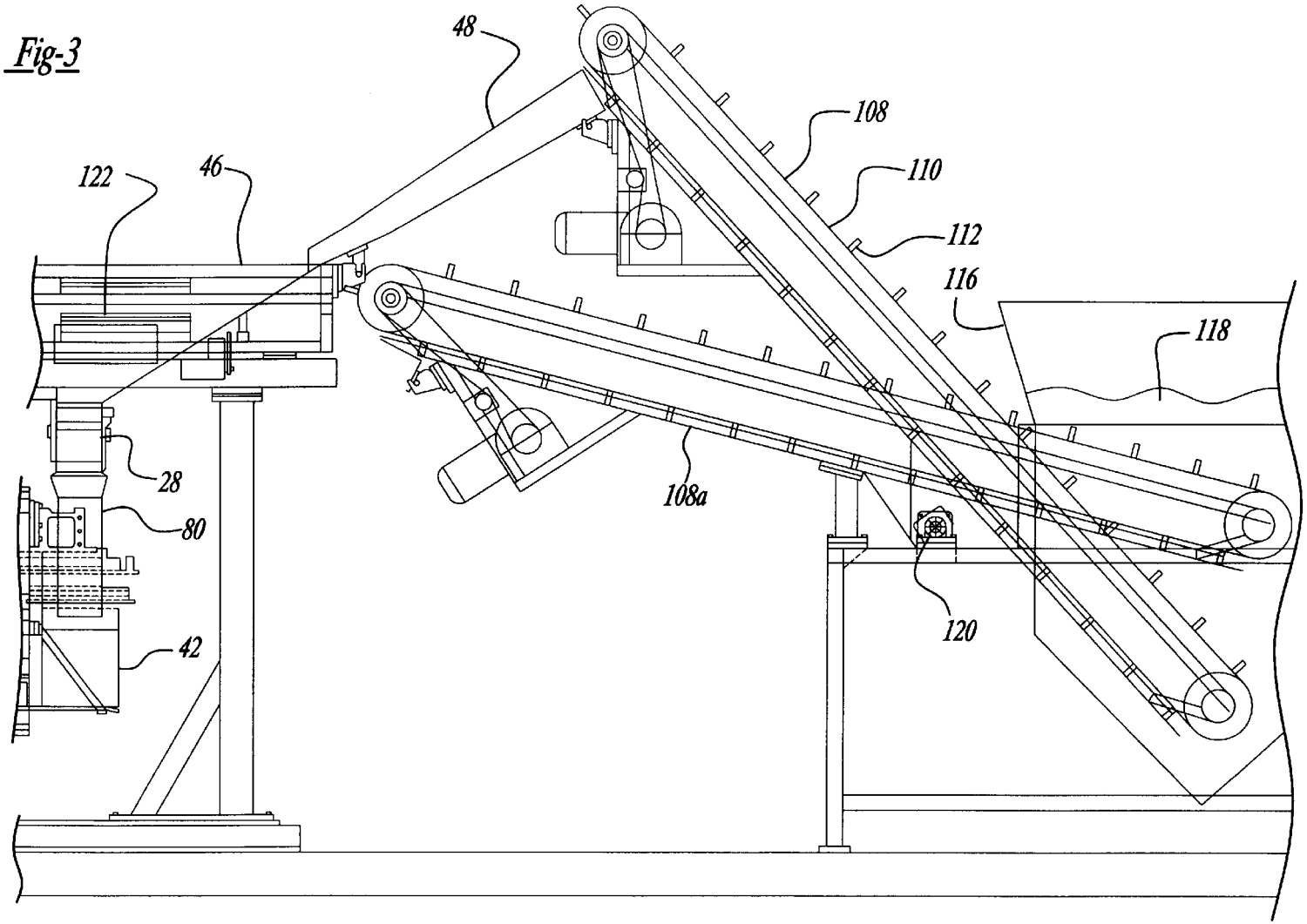
FIG. 3 is a side view of the conveyor assembly of FIG. 1.

Referring to FIG. 3, the cylinder fill station 28 generally comprises the lower fill chute 46 which is generally funnel shaped and positioned to fill the upper cylinder 80 of a sandbag carrier assembly 22, when the sandbag carrier assembly 22 is at the cylinder fill station 28. The upper fill chute 48 leads to the lower fill chute 46 from a conveyor 108. The conveyor 108 includes a belt 110 having a plurality of ribs for transporting sand from a hopper 116 containing a large supply of sand 118. The conveyor 108 is preferably movable pivotally around pivot point 120 from the raised operational position, as shown, to a lowered position for transport indicated at conveyor 108A. An auger 122 is preferably mounted in the lower fill chute 46 for moving sand into the upper cylinder 80 of the sandbag carrier assembly 22.

Figure 4:
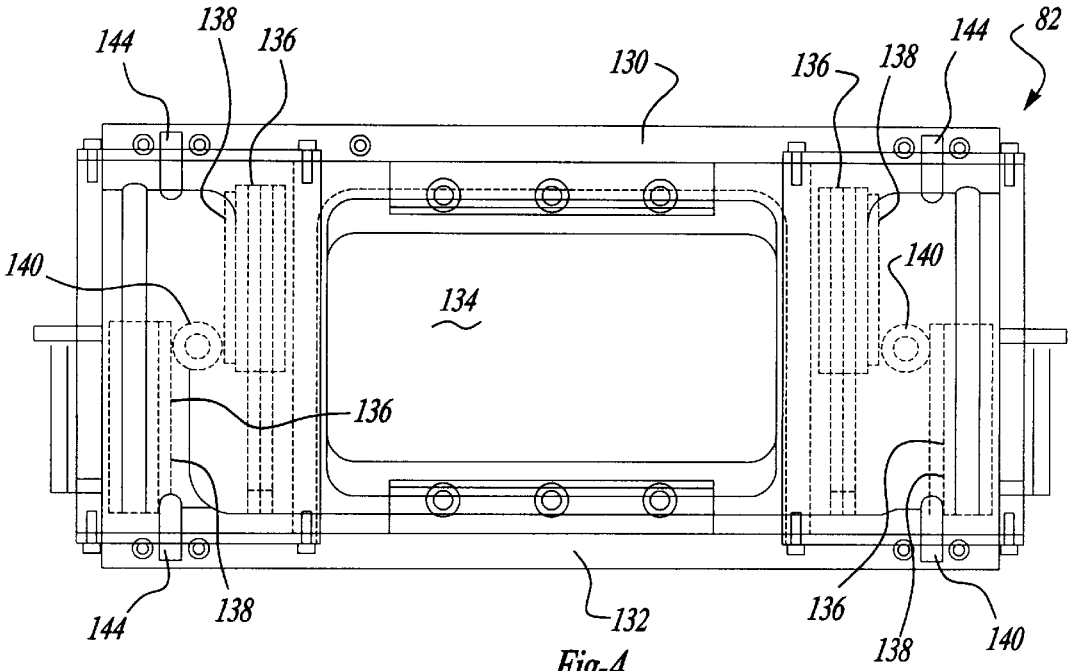
FIG. 4 is a top view of the lower portion of the sandbag carrier assembly of FIG. 1.

A top view of the lower portion 82 of the sandbag carrier assembly 22 is shown in FIG. 4. A pair of sliding plates 130, 132 are movable between an open position as shown and a generally closed position in which the sliding plates 130, 132 are generally abutting. In the open position, the sliding plates 130, 132 define a central rectangular opening 134. Each sliding plate 130, 132 includes a pair of racks 136 extending perpendicular to the plates 130, 132 on either side of the opening 134. Each of the racks 136 has a plurality of teeth 138 engaging a gear 140. As shown, each of two gears 140 engages a rack 136 from each of the sliding plates 130, 132, with the gear 140 positioned between the racks 136 from each sliding plate 130, 132. As a result, movement of either sliding plate 130, 132 toward or away from the other sliding plate 130, 132 will cause a complementary motion of the other sliding plate 130, 132.

Figure 5:
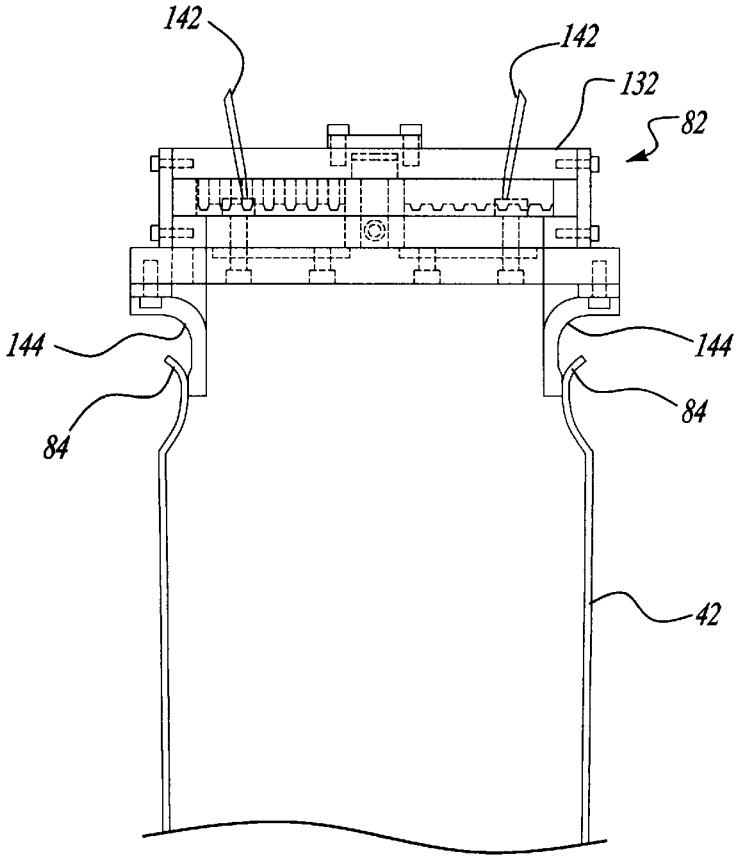
FIG. 5 is a side view of a lower portion of the sandbag carrier assembly of FIG. 4.

FIG. 5 shows a side view of the lower portion 82 of the sandbag carrier assembly 22. A shield 142 extends upwardly from each sliding plate 130, 132 to form a funnel above the central rectangular opening 134. A pair of L brackets 144 are attached to the underside of each sliding plate 130, 132. The fasteners 84 generally comprise hooks 84 extending upwardly from the lower end of the L bracket 144. The sandbag 42 is preferably plastic, such as nylon.

Figure 6:
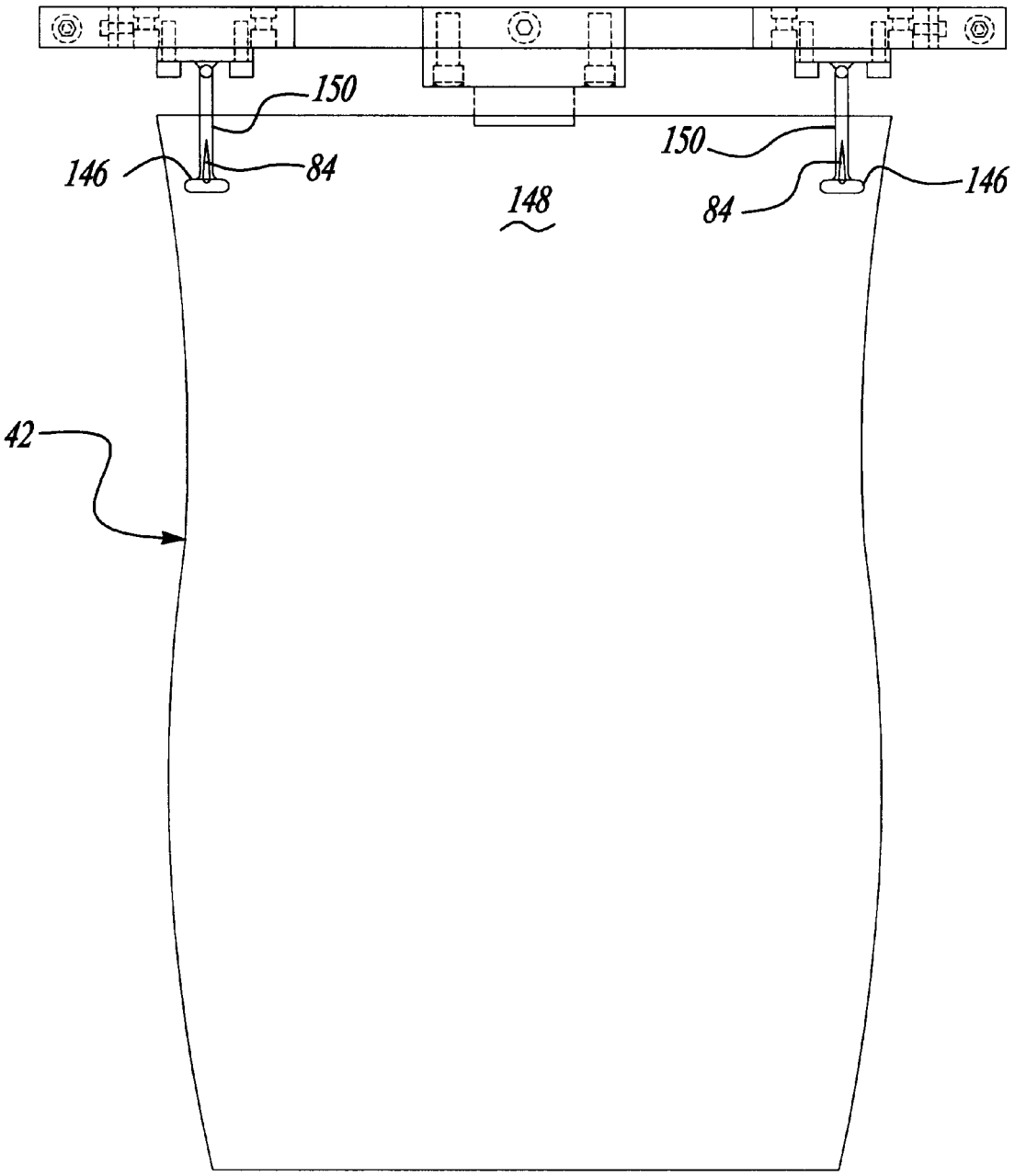
FIG. 6 is a front view of the sandbag and lower portion of the sandbag carrier assembly of FIG. 5.

Referring to FIG. 6, the hooks 84 are each inserted through a hole 146 formed in a reinforced portion 148 of the sandbag 42. A tear portion 150 is formed adjacent each of the holes 146. The tear portion 150 may comprise a perforation or portion of each thickness.

Figure 7:
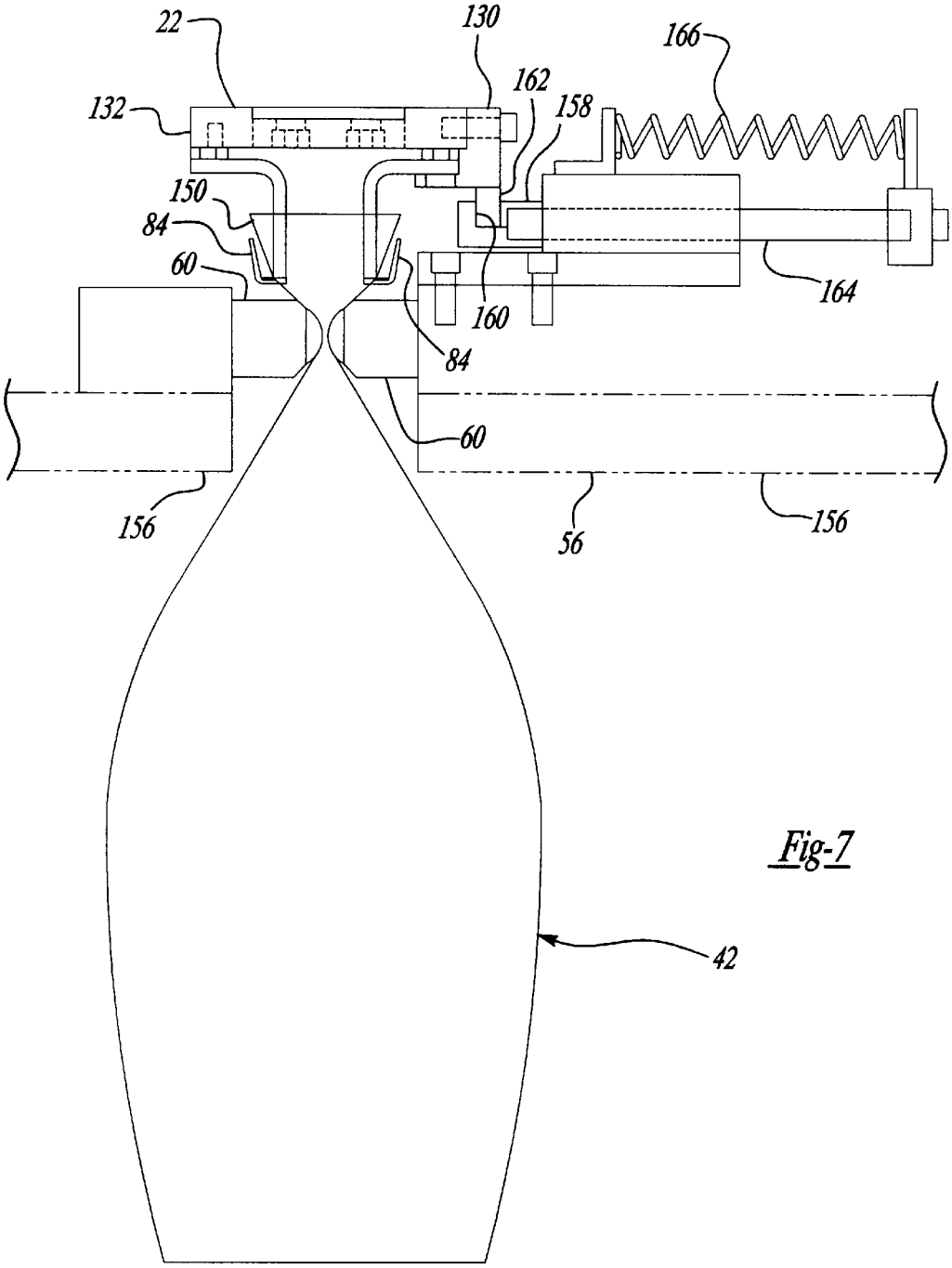
FIG. 7 is a sectional view of the sealing unit taken along line 7—7 of FIG. 1.

The seal unit 56 is shown more detail in FIG. 7. The seal unit 56 includes a pair of heat sealers 60 which selectively constrict and seal the sandbag 42 which is hanging on the adjacent sandbag carrier assembly 22. Each of the sealers 60 is mounted on a sealer carrier 156 which is selectively extended and retracted, such as by hydraulics or other means. The seal unit 56 further includes a bag closing slide 158 which includes a channel 160 into which fits a ridge 162 extending downwardly from one of the sliding plates 130. The bag closing slide 158 is selectively extended and retracted, such as by a hydraulic piston 154 for other means. A spring 166 may assist in the retraction of the bag closing slide 158.

In operation sandbags 42 are hung on the hooks 84 of the sandbag carrier assembly 22. The indexing unit 24 then moves the sandbag carrier assembly 22 to the cylinder fill station 28. At the cylinder fill station 28, the sand from the lower chute 46 is dropped into the upper cylinder 80 of the sandbag carrier assembly 22.

The indexing unit 24 then rotates the sandbag carrier assembly 22 to the bag fill station 30. At the bag fill station 30, the hydraulic actuator 52 opens the trap door 92 between the upper cylinder 80 and lower portion 82 of the sandbag carrier assembly 22. The sand in the upper cylinder 80 drops through the lower portion 82 into the sandbag 42. The sandbag carrier assembly 22 is then rotated to the sealing station 32.

The sealing unit 56 is then extended toward the indexing unit 24 and the ridge 162 on the sliding plate 130 is inserted into the channel 160 of the bag closing side 158. The bag closing slide 158 is then extended by the hydraulic piston 164 to close the sandbag 42. Movement of the sliding plate 130 inwardly also causes inward movement of the sliding plate 132, via the gears 140 and racks 136. During bag closing, the sealers 60 are also extended inwardly toward each other along with the bag closing slide 158. When the sliding plates 130,132 have moved fully inwardly, the sealers 60 continue to the move inwardly until the bag 42 is sealed. Then the sealers 60 are then retracted outwardly. The bag closing slide 158 is also retracted, causing sliding plates 130,132 to move outwardly. Since the bag 42 is sealed, movement of the sliding plates 130,132 outwardly causes hooks 84 to tear through the tear portions 150, thereby removing the sandbag 42 from the hooks 84. Subsequently, at the discharge station 34, the filled, sealed sandbag 42 is removed from the shelf 86 onto the discharge chute 66.

It should be recognized that the sandbag carrier assemblies could also be moved around the circuit by a conveyor assembly or other means. Further, the sealing unit 56 could be replaced with a heavy duty stapler, in which heavy wire is used to seal the opening of the sandbag 42. As an alternative, the indexing unit 24 may have four positions and four sandbag carrier assemblies 22. In this alternative embodiment, the functions of the cylinder fill station 28 and the bag fill station 30 would be performed at the same station.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. An automated sand bag filling unit comprising:

a plurality of sand bag carriers movable around a circuit, each sand bag carrier adapted to carry a sand bag;

a sand supply unit for supplying sand to said sand bag carriers, said sand supply unit positioned adjacent said circuit;

a sand bag sealer for sealing sand bags carried by said sand bag carriers, said sand bag sealer positioned adjacent said circuit;

said plurality of sand bag carriers each hold a sand bag in a generally open position when adjacent said sand supply unit and in a generally closed position when adjacent said sand bag sealer;

each sand bag carrier includes a plurality of fasteners for securing to a sand bag, said plurality of fasteners movable on said sand bag carrier between a generally open position and a generally closed position, said plurality of fasteners comprising a plurality of hooks for insertion into apertures in a sand bag.

2. The automated sand bag filling unit of claim 1 further comprising a plurality of sand bags, each sand bag removably secured to one of said plurality of sand bag carriers.

3. The automated sand bag filling unit of claim 1 wherein said plurality of sand bag carriers are mounted on an indexing unit, said indexing unit moving each of said sand bag carriers from said sand supply unit to said sand bag sealer.

4. The automated sand bag filling unit of claim 1 further including a loading station and a discharge station adjacent said circuit, said discharge station removing a sand bag from said sand bag carriers, said loading station including a plurality of sand bags for loading onto said sand bag carriers, said sand bag carriers moving sequentially from said loading station to said sand supply unit to said sand bag sealer to said discharge station.

5. The automated sand bag filling unit of claim 1 wherein said fasteners move to said generally open position after said sand bag sealer seals said sand bag.

6. The automated sand bag filling unit of claim 5 wherein each sand bag carrier includes an upper chamber disposed above said sand bag and a door between said upper chamber and said sand bag.

7. The automated sand bag filling unit of claim 6 wherein said door releases sand from said upper chamber into said sand bag after said sand bag carrier is no longer positioned adjacent said sand supply unit.

8. The automated sand bag filling unit of claim 7 wherein said plurality of sand bag carriers are mounted on an indexing unit, said indexing unit moving each of said sand bag carriers from said sand supply unit to said sand bag sealer.

9. The automated sand bag filling unit of claim 8 further including a loading station and a discharge station adjacent said circuit, said discharge station removing a sand bag from said sand bag carriers, said loading station including a plurality of sand bags for loading onto said sand bag carriers, said sand bag carriers moving sequentially from said loading station to said sand supply unit to said sand bag sealer to said discharge station.

10. An automated sand bag filling unit comprising:

a sand supply;

at least one sand bag carrier receiving sand from said sand supply, said sand bag carrier including a plurality of fasteners each having a first end attached to the filling unit and a and a second end for securing to a sand bag, said second ends of said plurality of fasteners selectively movable on said sand bag carrier toward each other from a generally open position to a generally closed position; and a sand bag sealer for sealing a sand bag carried by said sand bag carrier when said fasteners are in said generally closed position, wherein said at least one sand bag carrier is movable around a circuit between said sand supply and said sand bag sealer, said fasteners moving to said generally open position when adjacent said sand supply and to said generally closed position when adjacent said sand bag sealer.

11. A method for filling sand bags including the steps of:

a) hanging a sand bag having an opening on a plurality of first fasteners and a plurality of second fasteners each having a first end attached to the filling unit and a and a second end for securing to a sand bag, said first fasteners secured to a first edge of said opening of said sand bag, said second fasteners secured to a second edge of said opening of said sand bag;

b) filling the sand bag with sand through the opening in the sand bag while the second ends of the first and second fasteners are in an open position spaced apart from each other;

c) moving the second ends of the fasteners from the open position toward each other to a generally closed position after said step b); and d) removing the sand bag from the fasteners.

12. The method for filling sand bags of claim 11 wherein said step a) includes the step of inserting the fasteners through apertures in the sand bag, said step d) including the step of tearing the sand bag to remove the sand bag from the fasteners.

13. The method for filling sand bags of claim 12 wherein said fasteners are hooks said method further including the step of sealing said sand bag before said step d), and wherein said step d) further includes moving said hooks to said open position thereby tearing the sand bag from said hooks.

14. An automated sand bag filling unit comprising:

a plurality of sand bag carriers movable around a circuit, each sand bag carrier adapted to carry a sand bag, each sand bag carrier includes an upper chamber disposed above said sand bag and a door between said upper chamber and said sand bag;

a sand supply unit for supplying sand to said sand bag carriers, said sand supply unit positioned adjacent said circuit, said sand supply unit supplying sand into said upper chamber of each said sand carrier when each said sand carrier is positioned adjacent said sand supply unit, said door between said upper chamber opening and releasing the sand from said upper chamber into said sand bag after said sand supply unit supplies the sand to said upper chamber;

a sand bag sealer for sealing sand bags carried by said sand bag carriers, said sand bag sealer positioned adjacent said circuit.

* * * * *